US006199411B1

(12) United States Patent
Schenck et al.

(10) Patent No.: US 6,199,411 B1
(45) Date of Patent: Mar. 13, 2001

(54) DYEING RANGE UNLOADER

(75) Inventors: James Moore Schenck, Winston-Salem; George Stephen Noonkester, King; Bradford Lee Cheek, Yadkinville; Delois C. Brown, Winston-Salem; Randy R. Marsh, Walnut Cove, all of NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 09/259,462

(22) Filed: Mar. 1, 1999

(51) Int. Cl.[7] ..... D06B 15/02; D06B 23/00

(52) U.S. Cl. ..... 68/22 R; 19/159 R; 68/210; 493/937

(58) Field of Search ..... 68/22 R, 177, 68/210; 19/159 R; 493/413, 414, 415, 937; 270/39.05

(56) References Cited

U.S. PATENT DOCUMENTS 717,950 * 1/1903 Turner ..... 68/177
1,321,834 * 11/1919 Lyth ..... 68/177
1,431,412 * 10/1922 Murray ..... 68/22 R X
3,064,328 * 11/1962 McClure et al. ..... 68/177 X
3,083,437 * 4/1963 Davis, Jr. ..... 68/177 X
3,109,643 * 11/1963 Zimmerman ..... 68/177 X
4,654,910 * 4/1987 Kusuki et al. ..... 68/177 XD

* cited by examiner

*Primary Examiner*—Philip R. Coe
(74) *Attorney, Agent, or Firm*—Rhodes & Mason, PLLC

(57) ABSTRACT

An apparatus for folding a continuous length of fabric extracted from a dyeing range. The apparatus includes a fabric receptacle for receiving the fabric from the dyeing range and a two-directional plaiting system for folding the fabric. In the preferred embodiment, a control system controls the speed and tension of the fabric to prevent tearing or sagging of the fabric during unloading. Also, a pulley and squeegee system receives the continuous fabric and extracting liquid from the fabric prior to folding. The pulley and squeegee system includes a first nip drive and a second nip drive, each of the drives including a pair of rollers spaced apart to allow the continuous fabric to feed through the nip drives to extract excess water from the fabric.

47 Claims, 4 Drawing Sheets

DYEING RANGE UNLOADER

BACKGROUND OF THE INVENTION (1) Field of the Invention

The present invention relates generally to a device for automatically unloading fabric from a dyeing or finishing range, such as a jet dyeing machine, and, more particularly, a portable device for unloading fabric which is readily adaptable to a broad range of machinery.

(2) Description of the Prior Art

The production of fabric is a generally sequential process that ultimately finishes with a completed fabric of a certain type, color, and size or other predetermined specification. One of the steps of this process may be dyeing the fabric and then unloading it from the dye system in order to move the product along to the next step in the process. To facilitate transportation, the fabric is often unloaded from the dye system into tubs where it can be transported to the next downstream process or stored until needed. During a typical day of operation, the dye systems are in continuous use but are only unloaded on a periodic basis.

Previous attempts to automate the unloading process have had numerous drawbacks or other constraints. The dye system and the surrounding plant facility place a size constraint on the unloader. The dye systems are often placed in close proximity to other machinery to maximize the amount of dyeing equipment at one facility and production capability. Unfortunately, the close spacing of the machinery requires that unloading devices be relatively small to fit within the close dimensions. Previous unloaders are either too cumbersome to move in the tight quarters or require too much space.

Another drawback of existing unloaders is that a single facility may use a variety of dyeing ranges each having different physical dimensions, such as the placement and size of fabric removal ports. Previous unloading systems were adapted to fit only one specific type of machine and are unable to be used on other machinery having different physical dimensions. This requires that specific unloaders be purchased for each type of dyeing range which is expensive and also takes additional floor space in an already congested area. Alternatively, the unloaders are placed on each individual dye systems. This usage, however, is prohibitively expensive, an inefficient use of resources that require unnecessary duplication of a resource that is only periodically used, and sometimes impossible given space constraints.

Previous unloading systems have also required additional material handling of the fabric. Certain unloaders induced twists and bunches in the fabric which stretched the fabric and introduced other defects that required the fabric to be detwisted before further processing can be performed. Additionally, previous unloaders could not maintain a high unloading speed to keep the process flowing efficiently.

One type of previous unloader used a coiled removal system. This rotational system unloaded the dyeing range into a device similar to a large funnel. The funnel then coiled the fabric into tubs which were then pushed to the next downstream process. The funnel operated in a manner similar to a rope, causing twisting and stretching problems. This removal system did not meet the speed requirements, and did not use the tubs efficiently, as the coiled placement of the fabric did not fill the tub corners and center requiring the use of additional tubs to move the material and shutting down the unloader as the tubs were changed out.

Thus, there remains a need for a dye system unloading device that is capable of automatically unloading fabric from a dyeing range, such as a jet dyeing machine, at a high speed and reloadable in a short period of time while, at the same time, may be easily moved from dyeing range to dyeing range as needed.

SUMMARY OF THE INVENTION

The present invention is directed to an apparatus for folding a continuous length of fabric extracted from a dyeing range. The apparatus includes a fabric receptacle for receiving the fabric from the dyeing range and a two-directional plaiting system for folding the fabric.

The plaiting system has a first folder for folding the fabric in a first orientation. The first folder includes a track positioned adjacent to the fabric receptacle and a track follower movably attached to the track and movable along the length of the track. The fabric is guided by the track follower to guide and fold the fabric in the first orientation. A second folder folds the fabric in a second orientation across the fabric receptacle. The second folder includes a fabric guide for guiding the fabric; a second track extending across the width of the fabric receptacle; and a motor for reciprocating the fabric guide across the second track. Accordingly, the first folder and the second folder reciprocate simultaneously to fold the fabric being unloaded into the fabric receptacle.

In the preferred embodiment, a control system controls the speed and tension of the fabric to prevent tearing or sagging of the fabric during unloading. Also, a pulley and squeegee system receives the continuous fabric and extracting liquid from the fabric prior to folding. The pulley and squeegee system includes a first nip drive and a second nip drive, each of the drives including a pair of rollers spaced apart to allow the continuous fabric to feed through the nip drives to extract excess water from the fabric.

Accordingly, one aspect of the present invention is to provide an apparatus for folding a continuous length of fabric extracted from a dyeing range. The apparatus includes a fabric receptacle for receiving the fabric from the dyeing range; and plaiting system for folding the fabric, the plaiting system having a first folder for positioning the fabric in a first orientation, and a second folder for positioning the fabric in a second orientation; wherein the first folder and the second folder reciprocate simultaneously to fold the fabric being unloaded into the fabric receptacle.

Another aspect of the present invention is to provide an apparatus for removing a continuous length of fabric from a dyeing range. The apparatus includes: a fabric receptacle for receiving the fabric from the dyeing range; a first folder for folding the fabric in a first orientation, the first folder including: (i) a track positioned adjacent to the fabric receptacle; and (ii) a track follower movably attached to the track and movable along the length of the track, wherein the fabric is guided by the track follower to guide and fold the fabric in the first orientation; a second folder for folding the fabric in a second orientation across the fabric receptacle, the second folder including: (i) a fabric guide for guiding the fabric; (ii) a second track extending across the width of the fabric receptacle; and (iii) means for reciprocating the fabric guide across the second track, wherein the first folder and the second folder reciprocate simultaneously to fold the fabric being unloaded into the fabric receptacle; and a control system for controlling the speed and tension of the fabric to prevent tearing or sagging of the fabric during unloading.

Still another aspect of the present invention is to provide an apparatus for folding a continuous length of fabric extracted from a dyeing range. The apparatus includes: a fabric receptacle for receiving the fabric from the dyeing range; a plaiting system for folding the fabric, the plaiting system having a first folder for folding the fabric in a first orientation, the first folder including: (i) a track positioned adjacent to the fabric receptacle; and (ii) a track follower movably attached to the track and movable along the length of the track, wherein the fabric is guided by the track follower to guide and fold the fabric in the first orientation; and a second folder for folding the fabric in a second orientation across the fabric receptacle, the second folder including: (i) a fabric guide for guiding the fabric; (ii) a second track extending across the width of the fabric receptacle; and (iii) means for reciprocating the fabric guide across the second track, wherein the first folder and the second folder reciprocate simultaneously to fold the fabric being unloaded into the fabric receptacle; a control system for controlling the speed and tension of the fabric to prevent tearing or sagging of the fabric during unloading; and a pulley and squeegee system for receiving the continuous fabric and extracting liquid from the fabric, the pulley and squeegee system having a first nip drive and a second nip drive, each of the drives including a pair of rollers spaced apart to allow the continuous fabric to feed through the nip drives.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
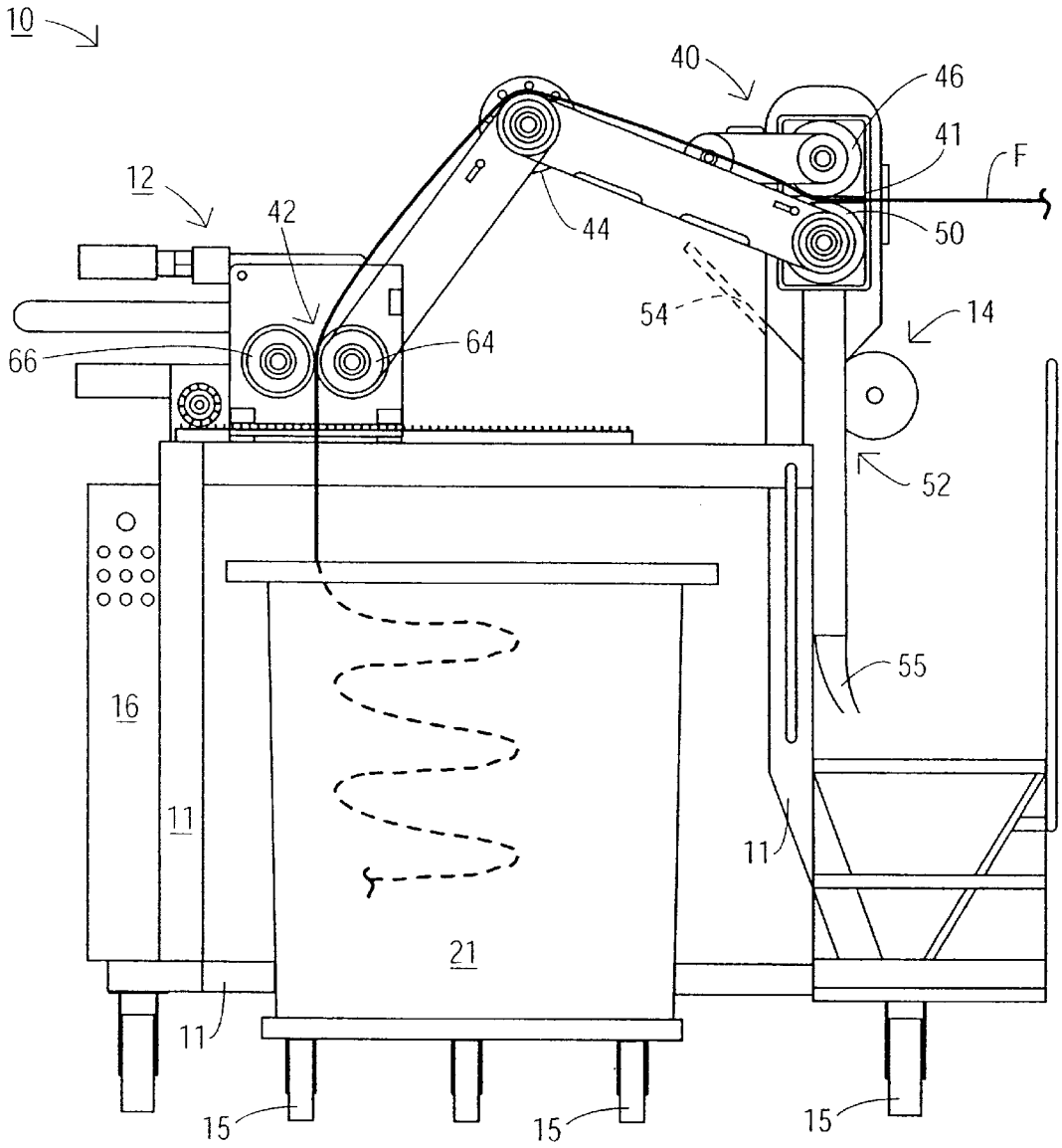
FIG. 1 is a front elevational view of a dyeing range unloader constructed according to the present invention.
Figure 2:
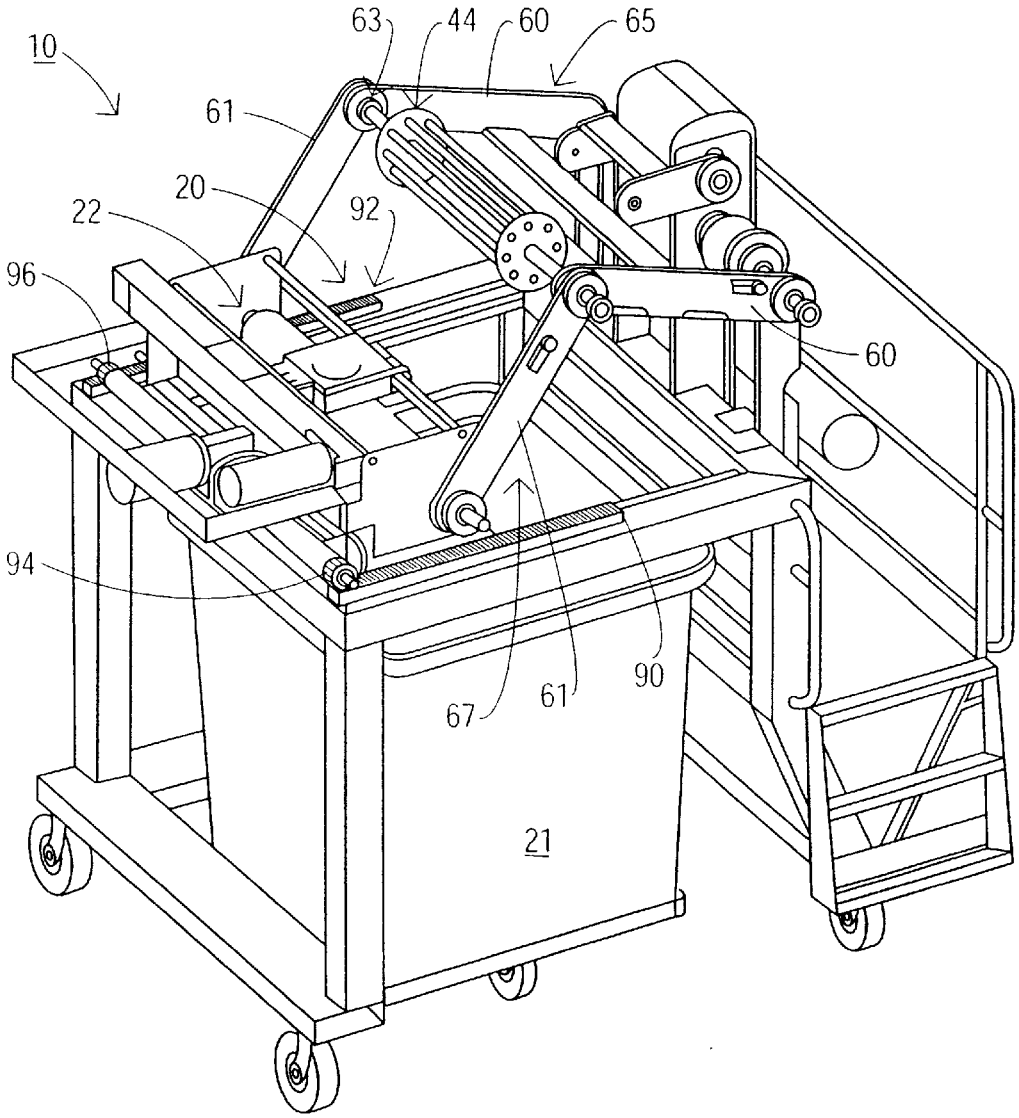
FIG. 2 is a top perspective view of the dyeing range unloader shown in FIG. 1.

In the following description, like reference characters designate like or corresponding parts throughout the several views. Also in the following description, it is to be understood that such terms as "forward", "rearward", "front", "back", "right", "left", "upwardly", "downwardly" and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a dyeing range unloader, generally designated 10, is shown according to the present invention. The unloader includes a plaiting system 12, a pulley/squeegee system 14 and a control system 16 for controlling the speed and tension of the fabric.

A frame 11 supports the components of the unloading system. The frame 11 is preferably mobile and may include wheels 15 or other roller assemblies attached to the frame base or bottom to provide both support and transportability.

Fabric "F" is first dyed upstream in a conventional dye vat or jet (not shown). One skilled in the art will also understand that the unloading system may also be adapted to remove fabric from other types of machinery such as a bleach range. The fabric "F" in the present invention is introduced into a fabric input guide 41 of the pulley/squeegee system 14. The fabric input guide 41 channels the fabric "F" into a first nip 40 formed by alignment of a first top roller 46 and a first bottom roller 50. The first top roller 46 is preferably formed of a corrosion resistant material, such as stainless steel. The first bottom roller 50 is preferably also formed of a corrosion resistant material, preferably rubber having a durometer in the range of between about 70 and 85, preferably about 80. first nip 40 is sized to accommodate fabric "F" without scuffing or crushing the fabric. The space between the first top roller 46 and the first bottom roller 50 is adjustable from a position in which the rollers are touching to a position having an opening of about four inches. Preferably, the rollers have a spring-loaded shock with a locking set screw to position the distance to the desired setting to accommodate various sizes and types of fabric. It will be understood by one of ordinary skill in the art that the alignment of the rollers could be varied such as top-and-bottom, side-by-side, etc.

When the fabric "F" passes through the first nip 40, liquid is pressed and extracted. A splashguard 54 is positioned downstream from the first nip 40 to divert the liquid from falling into a holding tub 21 or onto the fabric "F" during plaiting. A gutter 52 is positioned below the first nip 40 to receive liquid runoff extracted at the first nip and to channel the liquid away from the fabric F. In a preferred embodiment, the gutter 52 includes an upper funnel region 53 that tapers toward and connects with a hose 55 that directs the liquid runoff away from the unloader 10. The gutter 52 may be further connected to the frame 11 and aligned with the splashguard 54.

After the fabric "F" is driven through the first nip 40, the fabric passes over a tension roller 44 positioned downstream of the first nip 40. Arms 60 extend from the first nip roller 50 and arms 61 extend from the second nip roller 64 to pivotally connect to form a back support 65 and a front support 67. An axle 63 extends between the front support 65 and back support 67 for rotationally mounting the tension roller providing for rotation as the fabric passes between the first nip drive 40 and second nip drive 42.

Figure 3:
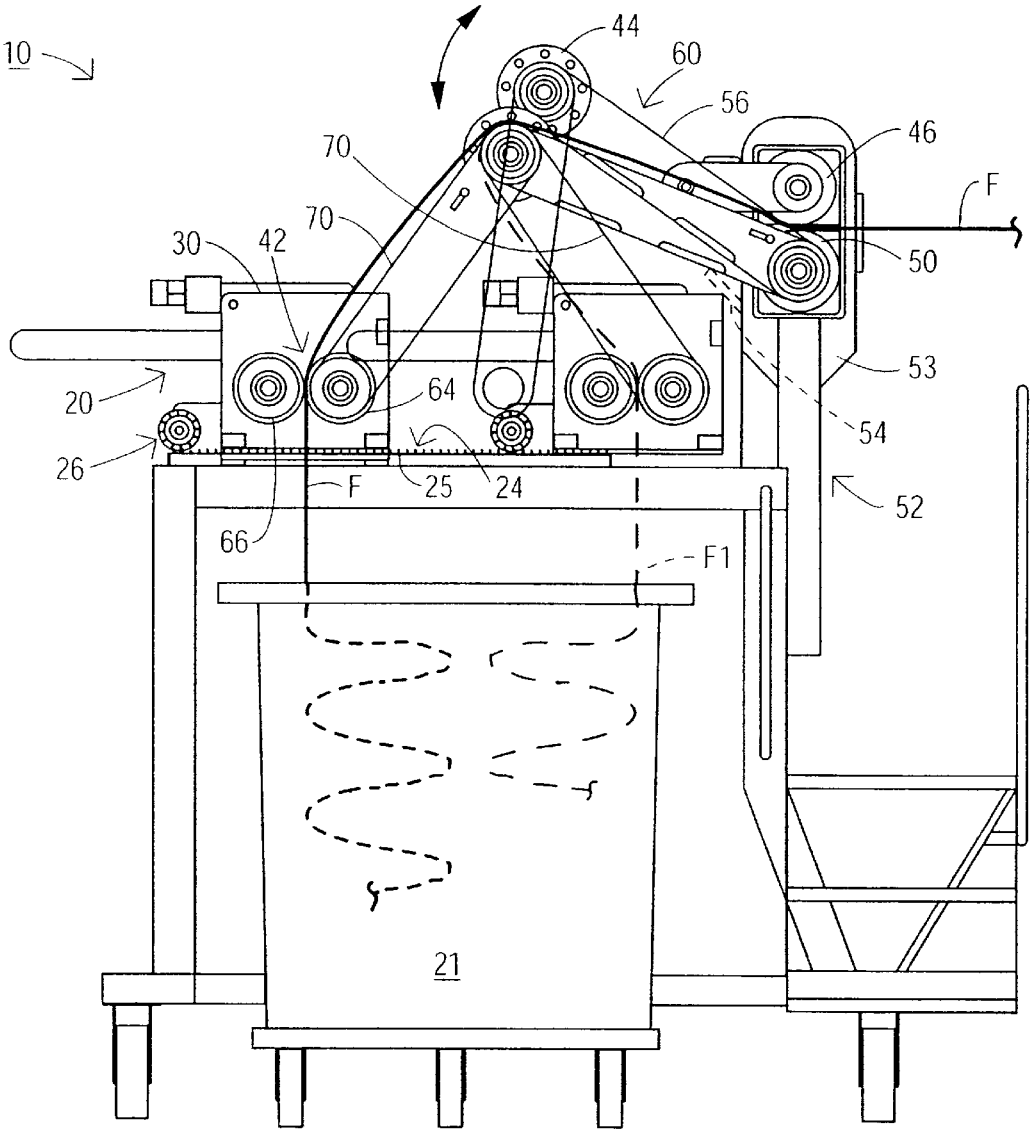
FIG. 3 is front elevational view of the first direction plaiting system of the dyeing range unloader.

The front and back supports 65, 67 of the tension system are connected to the first direction plaiting system as best illustrated in FIG. 3. As the plaiting system reciprocates, the tension roller is moved up and down to help maintain the tension of the fabric. In a preferred embodiment, the tension roller 44 and the drive roller are geared together in a one-to-one gear ration. One skilled in the art will recognize that the rollers may be geared in a number of arrangements including running independent of one another, depending upon the requirements of the system.

After passing over the tension roller 44, the fabric passes into a second nip 42 formed by alignment of a second left roller 66 and a second right roller 64. The second nip 42 is substantially identical to the first nip 40. The second right roller 64 is formed of a corrosion resistant material, preferably stainless steel. The second left roller 66 is formed of a corrosion resistant material, preferably rubber having a durometer between about 70 and 85, preferably 80. The second nip 42 is spaced to accommodate fabric "F" without scuffing or crushing the fabric. The space between the second left roller 66 and the second right roller 64 is adjustable from a position in which the rollers are touching to a position having an opening of about four inches. Preferably, the rollers have a spring-loaded shock with a locking set screw to position the distance to the desired setting to accommodate various sizes and types of fabric.

The plaiting system 12 includes a first direction plaiting system 20 and a second direction plaiting system 22 that function simultaneously to systematically and controllably distribute the fabric "F" into a receptacle, such as a tub 21, substantially filling the volume of the tub with fabric. As illustrated in FIG. 3, the first direction plaiting system 20 is formed by a first track 24, a first track follower 26, and the second nip 42, including both second right and left rollers, 64 and 66, respectively. In a preferred embodiment, the first track 24 includes a pair of spaced apart, parallel first tracks 90 and 92 aligned with the front and back edges of the second nip rollers 64, 66. Correspondingly, the first track follower 26 includes a pair of track followers 94 and 96 to interface with the parallel first tracks 90 and 92, respectively. Preferably, the pair of first track followers 94 and 96 arc toothed wheels which interface with corresponding toothed parallel first tracks 90 and 92 for providing controlled transverse movement thereon, as well as controlled stopping.

The track follower 26 reciprocates back and forth along the rails resulting in the fabric being folded in the first direction. The track follower 26 is geared with the second nip 42 to provide for the first direction plaiting system to move relative to the speed that fabric is pulled through the second nip 42. In one embodiment, the track follower 26 and the second nip 42 are both independently driven with single-phase servomotors. Limit switches are positioned on each of the ends of the rails to reverse the motion of the track follower 26 and maintain the plaiting system in a reciprocating maimer.

Figure 4:
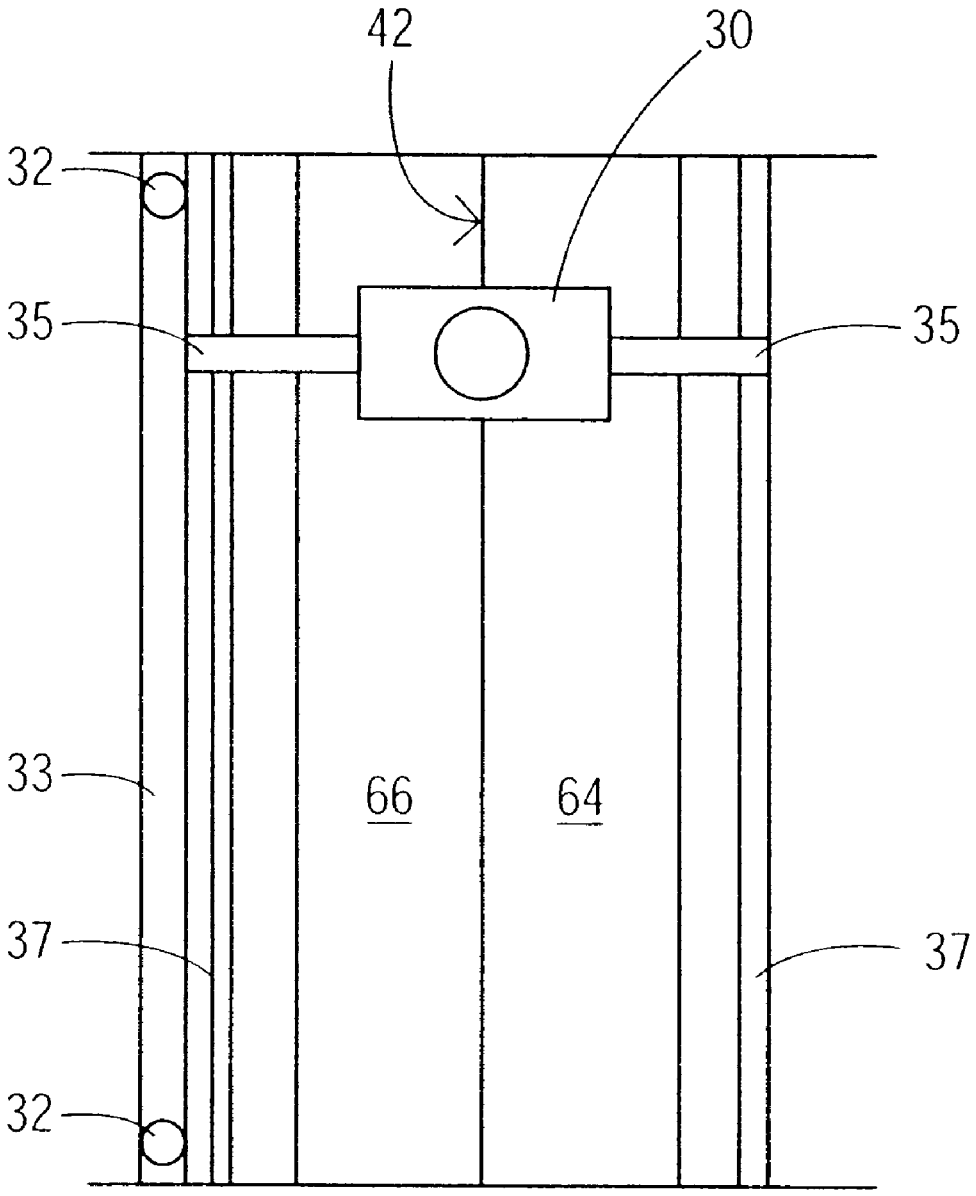
FIG. 4 is a top view of the fabric guide of the second direction plaiting system.

As illustrated in FIG. 4, the second direction plaiting system 22 is formed by a fabric guide 30 which reciprocates over the nip point 42. Support bars 35 extend outward from the fabric guide 30 and movably attach to rails 37 to maintain positioning and alignment. One of the support bars 35 is further connected to a pulley chain 33 which extends between a pair of pulleys 32. The pulleys 32 move the chain 33, and therefore the fabric guide 30, back and forth along the length of the rollers 64, 66 to plait the fabric in the second direction.

As the first direction plaiting system reciprocates in a left-to-right motion in relation to FIG. 1, the second direction plaiting system simultaneously reciprocates in a in-and-out motion to allow for the dual reciprocation and loading of the fabric holder 21. Preferably, the first direction and second direction plaiters are independently driven with single-phase servomotors.

In a preferred embodiment, the fabric guide 30 is a circular guide or ring having a smooth inner circumference with convex surfaces to prevent fabric snagging, scuffing or stretching. Preferably, the fabric guide is formed of non-corrosion resistant material, such as stainless steel.

Both the first and second direction plaiting systems 20, 22 are configured and collected to synchronously move with the second nip rollers 64, 66 so that a predetermined fabric plait pattern distributes the fabric "F" uniformly and consistently at any speed into the tub 21. By distributing the fabric "F" efficiently into the tub 21, the present invention is a substantial improvement over the previous plaiting systems. Table 1 lists plaiting systems with corresponding tub use efficiency.

The efficiency of tub usage of the present invention was compared to conventional rotational and half-plaiting. This was done by measuring the amount of fabric in yards which could be received by a tub of similar size. It was surprisingly discovered that the two-direction movement of the present invention was able to load twice as much fabric from the dyeing range into a similar size container.

TABLE 1

Relative Percentage of Volume of Tub filled in 1 hour

| Plaiting System type | Relative Tub Use Efficiency |
|---|---|
| Rotational Plaiting System (prior art) | 45% (1.0) |
| Half-Plaiting System (prior art) | 50% (1.1) |
| Present Invention | Substantially 100% (2.2) |

Control system 16 electro-mechanically connects the plaiting system 12 and pulley/squeegee system 14 for controlling the unloader speed, movement and fabric tension. T he control system 16 synchronizes the speed of first and second nip driven rollers 50, 64 to ensure the fabric is pulled through the system at an even pace to prevent tearing or sagging of the fabric which would result with uneven nip drive speeds. Preferably, drive motors are adjustable speed motors capable of pulling fabric at a rate between about 0 to about 300 yards per minute. One example of a motor used in the present invention is Model No. CP3661T-4 manufactured by Baldor. Also preferably, the control system 16 includes a brake or shut-off (not shown) for automatic unloader stopping and agog speed for rethreading or inputting fabric into the unloader. If a knot, tangle, fabric end or other situation occurs that causes a tension above or below a preselected amount, the control system 16 automatically stops the driven nip rolls 50, 64 and the plaiting system 12. further, the control system coordinates movement of the first and second direction plaiting systems 20, 22.

The control system 16, plaiting system 12 and squeegee system 14 are connected to a conventional AC power supply (not shown) and may be disconnected and reconnected to accommodate unloader 10 movement between dyeing range machines.

Certain modifications and improvements will occur to those skilled in the art upon a reading of the foregoing description. By way of example, while in the preferred embodiment a dyeing range unloader constructed according to the present invention is mobile and adaptable to multiple types of dyeing ranges or vats for fabric unloading, the unloader may be constructed for selective attachment to a single dyeing range or type of dyeing range. Alternatively, the frame may be adapted to movably connect with a track system (not shown) for selective movement along a linear arrangement of dye vats. Preferably, a track system would support the frame from above the dye vats. It should be understood that all such modifications and improvements have been deleted herein for the sake of conciseness and readability but are properly within the scope of the following claims.

We claim:

1. An apparatus for folding a continuous length of fabric extracted from a dyeing range, said apparatus comprising:

(a) a fabric receptacle for receiving the fabric from said dyeing range;

(b) a plaiting system for folding the fabric, said plaiting system having a first folder for positioning the fabric in a first orientation, and a second folder for positioning the fabric in a second orientation; wherein said first folder and said second folder reciprocate simultaneously to fold the fabric being unloaded into said fabric receptacle; and (c) a pulley and squeegee system for receiving the continuous fabric and extracting liquid from the fabric.

2. The apparatus according to claim 1, wherein said pulley and squeegee system includes a first nip drive and a second nip drive, each of said drives including a pair of rollers spaced apart to allow said continuous fabric to feed through said nip drives.

3. The apparatus according to claim 2, wherein said rollers of said first nip drive are positioned a fixed distance apart to squeeze moisture from said continuous fabric as the fabric passes between said rollers.

4. The apparatus according to claim 3, further including a splashguard positioned between said first nip drive and said fabric receptacle for sheltering said continuous fabric within said fabric receptacle from said liquid removed at said first nip drive.

5. The apparatus according to claim 3, further including a gutter positioned adjacent said first nip drive to collect said liquid removed from said continuous fabric.

6. The apparatus according to claim 5, wherein said gutter further includes a funnel positioned at an upper end of said gutter and a hose positioned at a lower end of said gutter for directing the moisture away from the fabric.

7. The apparatus according to claim 2, wherein each of said nip drive rollers are constructed of a corrosion resistant material.

8. The apparatus according to claim 7, wherein one of said rollers of each of said first and second nip drives includes a surface texture for increasing friction.

9. The apparatus according to claim 1, further including wheels for selectively moving said apparatus between a plurality of unloading stations and adaptable to accommodate a variety of dyeing range models and sizes.

10. The apparatus according to claim 9, wherein said fabric receptacle includes rollers for moving independently of said apparatus.

11. An apparatus for removing a continuous length of fabric from a dyeing range, said apparatus comprising:

(a) a fabric receptacle for receiving the fabric from said dyeing range;

(b) a first folder for folding the fabric in a first orientation, said first folder including: (i) a track positioned adjacent to said fabric receptacle; and (ii) a track follower movably attached to said track and movable along the length of said track, wherein the fabric is guided by said track follower to guide and fold the fabric in said first orientation;

(c) a second folder for folding the fabric in a second orientation across said fabric receptacle, said second folder including: (i) a fabric guide for guiding the fabric; (ii) a second track extending across the width of said fabric receptacle; and (iii) means for reciprocating said fabric guide across said second track, wherein said first folder and said second folder reciprocate simultaneously to fold the fabric being unloaded into said fabric receptacle; and (d) a control system for controlling the speed and tension of the fabric to prevent tearing or sagging of the fabric during unloading, wherein said control system includes a first nip drive for controlling the speed of said continuous fabric through said apparatus, said first nip drive having a first roller and a second roller spaced apart a fixed distance to allow the fabric to feed between as said rollers are rotated.

12. The apparatus according to claim 11, wherein said first track includes a pair of substantially parallel members extending across said fabric receptacle.

13. The apparatus according to claim 12, wherein said track follower includes a pair of toothed gears that interface with each of said parallel members for moving the fabric along the length of said fabric receptacle.

14. The apparatus according to claim 11, wherein said second track includes a pair of substantially parallel rods extending across the width of said fabric receptacle for folding the fabric in a second orientation.

15. The apparatus according to claim 14, further including connectors attached to said parallel rods and connected to said fabric guide allowing for said fabric guide to move along the width of said fabric receptacle.

16. The apparatus according to claim 15, further including a belt system for reciprocating said fabric guide along said parallel rods.

17. The apparatus according to claim 11, wherein said control system is connected to said first nip drive first roller for controlling the speed of the fabric.

18. The apparatus according to claim 17, wherein said control system adjusts the speed of the fabric between about 0 and 300 yards per minute.

19. The apparatus according to claim 11, wherein said control system further includes a brake for stopping the rotation of the first roller and thereby the movement of the fabric.

20. The apparatus according to claim 11, wherein said control system further includes agog control for feeding short lengths of the fabric through said first nip drive.

21. The apparatus according to claim 11, further including a tension arm located downstream of said first nip drive for maintaining a tension on the fabric, said tension arm including a roller wheel attached to a first end of said tension bar.

22. The apparatus according to claim 21, further including a second nip drive located downstream of said first nip drive, said second nip drive operating at substantially the same speed as said first nip drive to provide a substantially constant speed on the fabric as it passes between said first and second nip drives.

23. The apparatus according to claim 22, wherein said second nip drive further includes a brake for stopping the fabric, said brake being controlled by said control system.

24. The apparatus according to claim 23, wherein said first nip drive includes a tension device controlled by said control system for monitoring the tension on the fabric, said tension device including an automatic shut off when the fabric tension is outside of a predetermined range.

25. An apparatus for folding a continuous length of fabric extracted from a dyeing range, said apparatus comprising:

(a) a fabric receptacle for receiving the fabric from said dyeing range;

(b) a plaiting system for folding the fabric, said plaiting system having a first folder for folding the fabric in a first orientation, said first folder including: (i) a track positioned adjacent to said fabric receptacle; and (ii) a track follower movably attached to said track and movable along the length of said track, wherein the fabric is guided by said track follower to guide and fold the fabric in said first orientation; and a second folder for folding the fabric in a second orientation across said fabric receptacle, said second folder including: (i) a fabric guide for guiding the fabric; (ii) a second track extending across the width of said fabric receptacle; and (iii) means for reciprocating said fabric guide across said second track, wherein said first folder and said second folder reciprocate simultaneously to fold the fabric being unloaded into said fabric receptacle;

(c) a control system for controlling the speed and tension of the fabric to prevent tearing or sagging of the fabric during unloading; and (d) a pulley and squeegee system for receiving the continuous fabric and extracting liquid from the fabric, said pulley and squeegee system having a first nip drive and a second nip drive, each of said drives including a pair of rollers spaced apart to allow said continuous fabric to feed through said nip drives.

26. The apparatus according to claim 25, wherein said rollers of said first nip drive are positioned a fixed distance apart to squeeze moisture from said continuous fabric as the fabric passes between said rollers.

27. The apparatus according to claim 26, further including a splashguard positioned between said first nip drive and said fabric receptacle for sheltering said continuous fabric within said fabric receptacle from said liquid removed at said first nip drive.

28. The apparatus according to claim 26, further including a gutter positioned adjacent said first nip drive to collect said liquid removed from said continuous fabric.

29. The apparatus according to claim 28, wherein said gutter further includes a funnel positioned at an upper end of said gutter and a hose positioned at a lower end of said gutter for directing the moisture away from the fabric.

30. The apparatus according to claim 25, wherein each of said nip drive rollers are constructed of a corrosion resistant material.

31. The apparatus according to claim 30, wherein one of said rollers of each of said first and second nip drives includes a surface texture for increasing friction.

32. The apparatus according to claim 25, further including wheels for selectively moving said apparatus between a plurality of unloading stations and adaptable to accommodate a variety of dyeing range models and sizes.

33. The apparatus according to claim 32, wherein said fabric receptacle includes rollers for moving independently of said apparatus.

34. The apparatus according to claim 25, wherein said first track includes a pair of substantially parallel members extending across said fabric receptacle.

35. The apparatus according to claim 34, wherein said track follower includes a pair of toothed gears that interface with each of said parallel members for moving the fabric along the length of said fabric receptacle.

36. The apparatus according to claim 25, wherein said second track includes a pair of substantially parallel rods extending across the width of said fabric receptacle for folding the fabric in a second orientation.

37. The apparatus according to claim 36, further including connectors attached to said parallel rods and connected to said fabric guide allowing for said fabric guide to move along the width of said fabric receptacle.

38. The apparatus according to claim 37, further including a belt system for reciprocating said fabric guide along said parallel rods.

39. The apparatus according to claim 25, wherein said control system includes a first nip drive for controlling the speed of said continuous fabric through said apparatus, said first nip drive having a first roller and a second roller spaced apart a fixed distance to allow the fabric to feed between as said rollers are rotated.

40. The apparatus according to claim 39, wherein said control system is connected to said first nip drive first roller for controlling the speed of the fabric.

41. The apparatus according to claim 40, wherein said control system adjusts the speed of the fabric between about 0 and 300 yards per minute.

42. The apparatus according to claim 39, wherein said control system further includes a brake for stopping the rotation of the first roller and thereby the movement of the fabric.

43. The apparatus according to claim 39, wherein said control system further includes a jog control for feeding short lengths of the fabric through said first nip drive.

44. The apparatus according to claim 39, further including a tension arm located downstream of said first nip drive for maintaining a tension on the fabric, said tension arm including a roller wheel attached to a first end of said tension bar.

45. The apparatus according to claim 44, further including a second nip drive located downstream of said first nip drive, said second nip drive operating at substantially the same speed as said first nip drive to provide a substantially constant speed on the fabric as it passes between said first and second nip drives.

46. The apparatus according to claim 45, wherein said second nip drive further includes a brake for stopping the fabric, said brake being controlled by said control system.

47. The apparatus according to claim 46, wherein said first nip drive includes a tension device controlled by said control system for monitoring the tension on the fabric, said tension device including an automatic shut off when the fabric tension is outside of a predetermined range.

* * * * *